US008569606B2

(12) United States Patent
Khoo et al.

(10) Patent No.: US 8,569,606 B2
(45) Date of Patent: Oct. 29, 2013

(54) MUSIC AND LIGHT SYNCHRONIZATION SYSTEM

(75) Inventors: Chun Kiong Leslie Khoo, Singapore (SG); Shuang Zhang, Singapore (SG)

(73) Assignees: Panasonic Corporation, Osaka (JP); Panasonic Semiconductor Asia Pte.Ltd., Singapore (SG)

( * ) Notice: Subject to any disclaimer, the term of this patent is extended or adjusted under 35 U.S.C. 154(b) by 77 days.

(21) Appl. No.: 13/048,010

(22) Filed: Mar. 15, 2011

(65) Prior Publication Data

US 2012/0234160 A1 Sep. 20, 2012

(51) Int. Cl.
*G10H 1/36* (2006.01)

(52) U.S. Cl.
USPC ..... 84/609; 84/610; 84/626; 84/634

(58) Field of Classification Search
USPC ..... 84/609
See application file for complete search history.

(56) References Cited

U.S. PATENT DOCUMENTS

| | | | | | |
|---|---|---|---|---|---|
| 4,358,754 | A * | 11/1982 | Young et al. | ..... | 340/815.46 |
| 5,245,341 | A * | 9/1993 | Maeder | ..... | 341/131 |
| 5,287,108 | A * | 2/1994 | Mayes et al. | ..... | 341/156 |
| 6,603,416 | B2 * | 8/2003 | Masenas et al. | ..... | 341/120 |
| 7,228,190 | B2 * | 6/2007 | Dowling et al. | ..... | 700/94 |
| 7,473,837 | B2 * | 1/2009 | Cui et al. | ..... | 84/464 R |
| 8,437,480 | B2 * | 5/2013 | Zong et al. | ..... | 381/71.11 |
| 2008/0240451 | A1 * | 10/2008 | Takahashi | ..... | 381/57 |

* cited by examiner

*Primary Examiner* — Christopher Uhlir
(74) *Attorney, Agent, or Firm* — Greenblum & Bernstein, P.L.C.

(57) ABSTRACT

An apparatus for synchronizing light signals to a music input signal includes an analog to digital converter to generate a digital signal equivalent of the analog music input signal, an digital signal decoder to generate an output pulse width modulated signal that is representative of the tempo and the volume of the music input signal, a light driver unit that receives the output pulse width modulated signal to correspondingly light up a lighting unit, and a lighting unit that emits light. Thus, light brightness synchronizes with the music volume amplitude, and the light blinks on and off with the music tempo and beating.

3 Claims, 6 Drawing Sheets

Fig.6

V3

| S8 | S7 | S6 | S5 | S4 | S3 | S2 | S1 | AMPLITUDE DETECTOR (V4) | THRESHOLD (V2) | PWM DUTY (V8) |
|---|---|---|---|---|---|---|---|---|---|---|
| 1 | X | X | X | X | X | X | X | 8 | S8 | 100% |
| 0 | 1 | X | X | X | X | X | X | 7 | S7 | 87.5% |
| 0 | 0 | 1 | X | X | X | X | X | 6 | S6 | 75% |
| 0 | 0 | 0 | 1 | X | X | X | X | 5 | S5 | 62.5% |
| 0 | 0 | 0 | 0 | 1 | X | X | X | 4 | S4 | 50% |
| 0 | 0 | 0 | 0 | 0 | 1 | X | X | 3 | S3 | 37.5% |
| 0 | 0 | 0 | 0 | 0 | 0 | 1 | X | 2 | S2 | 25% |
| 0 | 0 | 0 | 0 | 0 | 0 | 0 | 1 | 1 | S1 | 12.5% |
| 0 | 0 | 0 | 0 | 0 | 0 | 0 | 0 | 0 | S0 | 0% |

MUSIC AND LIGHT SYNCHRONIZATION SYSTEM

BACKGROUND OF THE INVENTION (1) Field of the Invention

The present invention relates to a music and light synchronization system, and more particularly, to an apparatus for synchronizing light signals to a music input signal, whereby light can be made to synchronize with music that is being played. This system helps to create light and music synchronization and can be used in systems where light and sound is being produced.

(2) Description of Related Art

Above mentioned system can be used in devices like TVs, Mobile phone, GPS-enabled devices, DVD player, MP3 and portable media devices etc. Using this system, light and visual effect can be made to synchronize with music signal which can be a mobile ring tone or music track from player. This creates interesting visual effect with light that blinks along with the music tempo and with brightness level auto adjusting corresponding to the volume of music.

FIG. 1 shows the use of conventional technology to create light and music synchronization effect. The system 10 uses a few building blocks to create this effect. First, music signal is inputted into a volume detection decoder 11. Volume detection decoder 11 is typically implemented by the Analog to Digital Converter (ADC) technique, further implemented by comprising the use of complex architecture such as the sigma delta system. Analog music signal is converted into digital signal for decoding purpose. After the analog music amplitude or volume has converted into digital signal, it will be passed into a PWM decoder 12. PWM decoder 12 typically consists of a lookup table to convert the decoded music amplitude into a Pulse Width Modulated (PWM) signal. In the decoding process, the larger is the amplitude, the larger is the duty cycle of the PWM signal. This PWM signal is in turn inputted into an LED Driver Unit 13 which can exemplarily be in the form of a transistor that has the ability to be turned on and off by the PWM signal and in turn passes current into the lighting unit 14 which can exemplarily be in the form of an LED that produces light when current passes through it.

There are some problems associated to the use of the abovementioned conventional technique. One of which is the use of the volume detection decoder 11. This system may result in many components being created and in turned cause high system development cost, besides being an expensive solution to offer. Another problem of using this conventional method is that Light brightness will be seen unchanged when music is either very loud or very soft. This is due to human eyes are not able to tell the difference in fine levels of LED brightness adjustment due to PWM signal changes. Using this type of system, LED light will be seen as static especially when music volume level is too high or low making Light output not able to synchronize with the music tempo and beat. The present invention aims to create a system that improves with technique of Light and music synchronization and at the same time solving the above mentioned problems of the present system.

BRIEF SUMMARY OF THE INVENTION

The purpose of this invention is to provide an apparatus that helps to synchronize light with the current music being played.

According to the present invention, an apparatus for synchronizing light signals to a music input signal, comprises: an analog to digital converter to generate a digital signal equivalent of the analog music input signal; a digital signal decoder to generate an output pulse width modulated signal that is representative of the tempo and the volume of the music input signal; a light driver unit that receives the output pulse width modulated signal to correspondingly light up a lighting unit; and a lighting unit that emits light.

According to the present invention, the analog to digital converter comprises: a first resistor ladder network to provide a DC bias to the music input signal; a second resistor ladder network to generate threshold levels for comparing with the DC biased music input signal; an auto threshold scanner coupled to said second resistor ladder network to generate a staircase waveform; and an amplitude comparator to compare the staircase waveform and the DC biased music input signal.

According to the present invention, the auto threshold scanner comprises: an auto switching block that couples each of the resistors in the second resistor ladder network to said amplitude comparator through switches; and a scanning logic block that sequentially outputs enabling and disabling signals to the auto switching block so that only one of said switches will be enabled and the rest will be disabled.

According to the present invention, said digital signal decoder comprises: an amplitude detector to store the current step information of the staircase waveform for which said amplitude comparator outputs a signal corresponding to the instantaneous amplitude of the music input signal; a music tempo decoder that takes in the stored current step information to perform an averaging of the input signals within a pre-determined time frame, and compare the averaged signal with the instantaneous amplitude of the music input signal, so as to output a first pulse width modulated signal; and a music volume decoder that takes in the stored current step information to produce a second pulse width modulated signal that has a duty cycle linearly proportional to the amplitude of the music input signal.

According to the present invention, the digital signal decoder further comprises: a summing unit to integrate the outputs of the music tempo decoder and the music volume decoder so as to generate the output pulse width modulated signal for said light driver unit to light up said lighting unit with brightness corresponding to the music volume decoder output, and a blinking effect corresponding to the music tempo decoder output.

According to the present invention, the music tempo decoder comprises: a peak amplitude detector that takes in the stored current step information and stores the maximum current step information out of a sampling of a pre-determined number of maximum current step information; an averaging amplitude unit that takes in a pre-determined number of samples of the stored said maximum current step information and performs operations to obtain an average of these stored said maximum current step information; and an averaging amplitude comparator to compare the stored current step information and the average of the stored said maximum current step information.

BRIEF DESCRIPTION OF THE SEVERAL VIEWS OF THE DRAWINGS

FIG. 6 shows the exemplary implementation of the look up table format to generate PWM signal that is linearly proportional to music volume level.

DETAILED DESCRIPTION OF THE INVENTION

Figure 1:
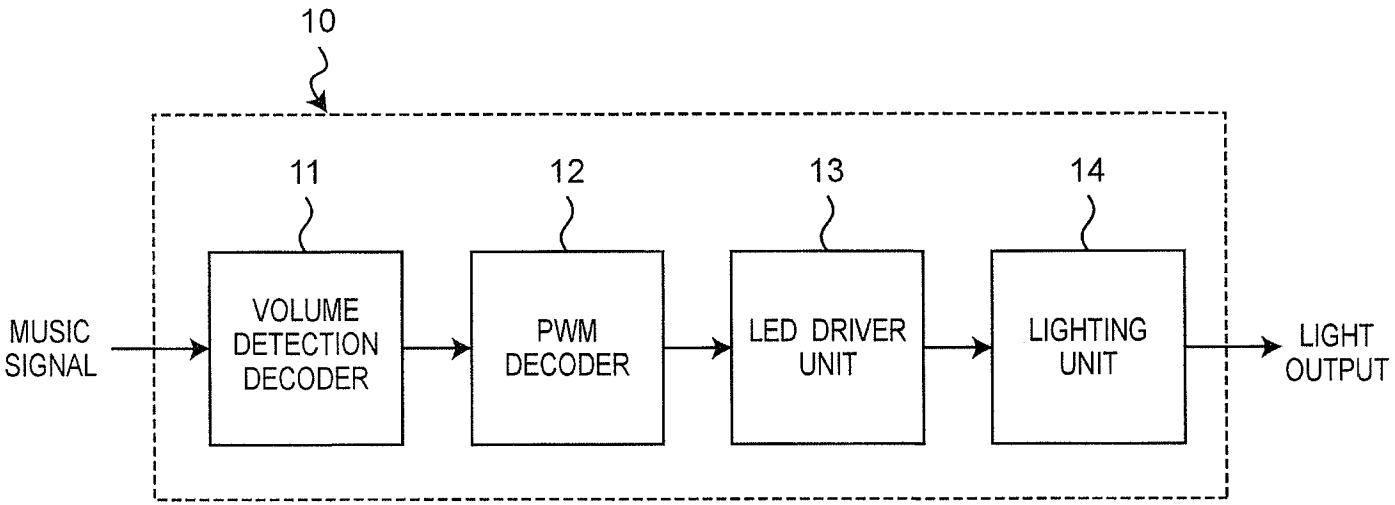
Fig.1 PRIOR ART
FIG. 1 shows a prior art technology system for synchronizing light signal to music.
Figure 2:
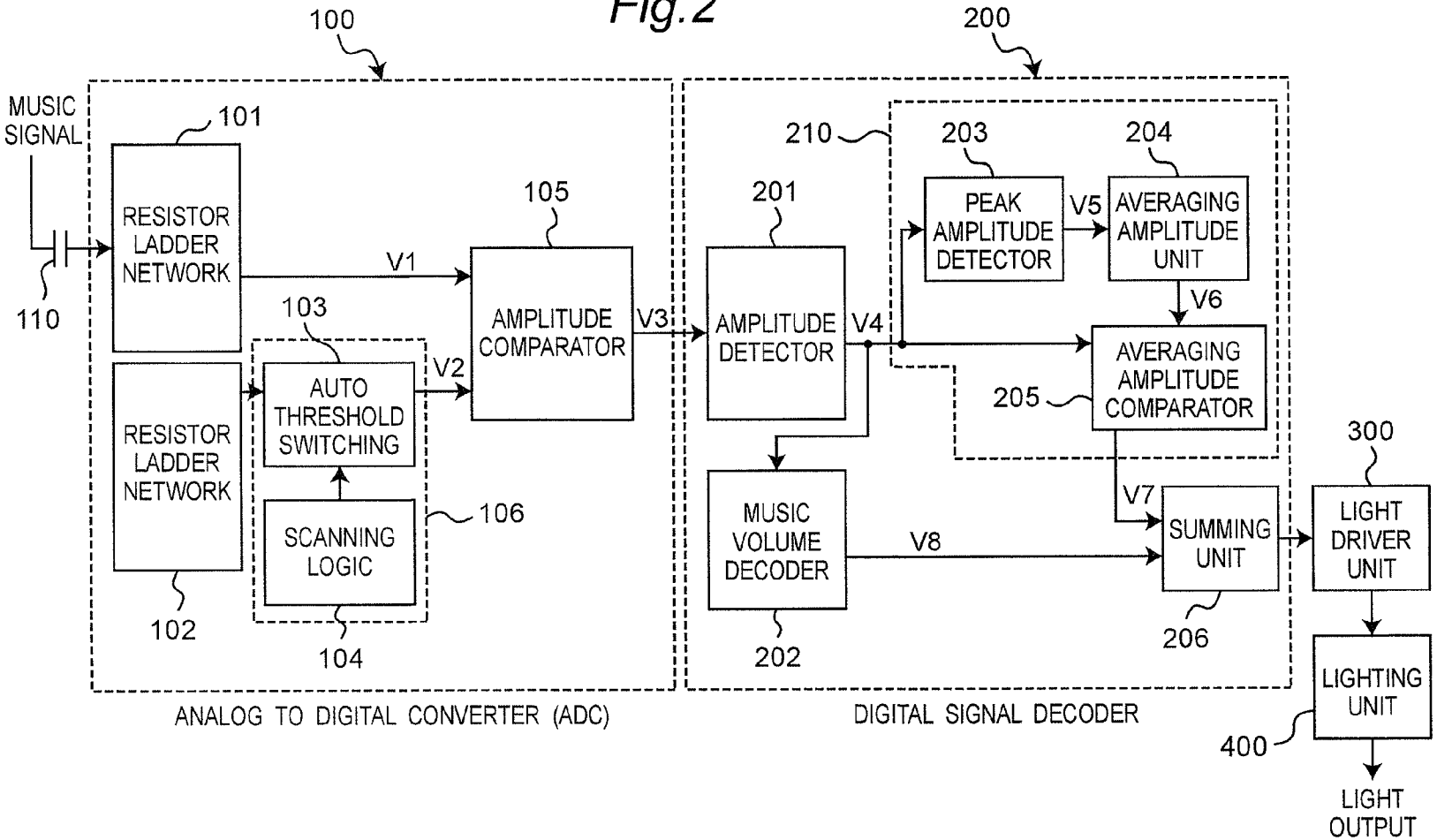
FIG. 2 shows an embodiment based on the present invention.

Referring to FIG. 2, an embodiment of the present invention with reduced component count for a music and light synchronization system is shown. The music and light synchronization system has two main portions, the analog to digital converter (ADC) 100 for producing a music or sound signal and a digital signal decoder 200. The output of the digital signal decoder 200 is fed to a light driver unit 300 and further to a lighting unit 400.

Figure 3:
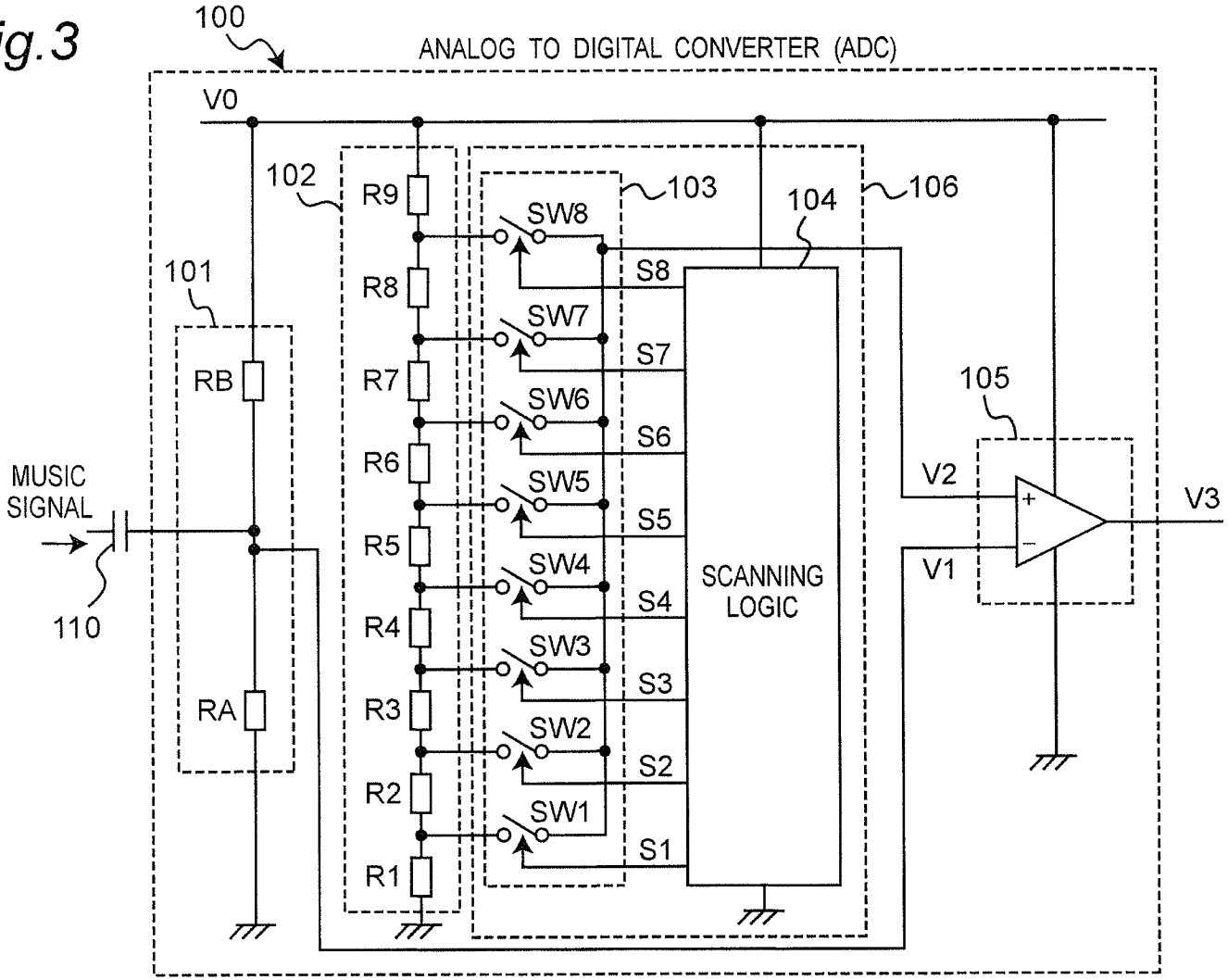
FIG. 3 shows the exemplary implementation of the analog to digital converter (ADC).

Referring to FIG. 3, the analog to digital converter 100 comprises two resistor ladder networks 101 and 102, the first one 101 is for generating DC biasing for an inputted music signal and the second one 102 is for generating threshold reference voltage for music level comparison. The threshold reference voltage is also auto scanned repeatedly to continuously compare with the inputted music signal. Auto scanning is performed by an auto threshold scanner 106; whereas the music level comparison is performed by the amplitude comparator 105.

Output of the analog to digital converter 100 is coupled to the digital signal decoder 200 which is for signal processing. The processing will take in the music amplitude level and generate a signal to drive the lighting unit and to produce light that is synchronize with music. The digital signal decoder 200 comprises three basic parts.

The first basic part is an amplitude detector 201, whose function is to act as a memory or latch to store the value of the digital output V3 of the amplitude comparator 105.

The second part is a music tempo decoder 210. Music tempo decoder 210 functions to generate 'on' and 'off' signals that shut down light when the instantaneous volume (or amplitude) of the music input signal is lower than an average amplitude that is monitored. The end effect of this portion is to generate light that "blinks" (On/Off) in accordance to the music tempo that is being played. This also helps to solve the problem of conventional technology method where light may seem static even when music tempo beating is still taking place especially during loud or low volume region. A more detailed explanation of the music tempo decoder 210 through its exemplary implementation will be explained later.

The third part is a music volume decoder 202. The music volume decoder 202 inputs the latched digital output V3 of the amplitude comparator 105, as latched by the amplitude detector 201. The music volume decoder 202 generates a signal that is synchronized to the music volume by producing a pulse that has duty cycle linearly proportional to music volume amplitude. This helps to create light that is brighter when volume is larger and dims when music volume is softer. A more detailed explanation of the music volume decoder 202 through its exemplary implementation will be explained later.

By combining the three basic parts described, the present invention is able to combine the effect of light being synchronized with music not in terms of volume amplitude only, but also synchronizes together with music tempo and beating. This allows better synchronization effects visually and more obvious to human eyes.

An exemplary implementation of the analog to digital converter 100 shall now be described. The analog to digital converter 100 is made up of a few functional blocks as shown in FIG. 2. The music signal inputted is first fed into a resistor ladder network 101 through a DC filtering capacitor 110. The resistor ladder network 101 helps to bias the music signal to a predefined DC level V1' to enable amplitude detection. As shown in FIG. 3, an exemplary implementation of the resistor ladder network 101 includes resistors RA and RB. Voltage of the predefined DC level V1' is generated by the following relationship:

$$V1'=RA/(RA+RB)*V0,$$

where V0 can be the voltage supply to analog to digital converter 100 or any other reference supply level. The predefined DC level V1 will be the DC level on which the music signal will be riding on during amplitude detection. In order to compare this music signal amplitude, there is a need to generate a set of reference threshold levels. These reference threshold levels are generated by resistor ladder network 102. The resistor ladder network 102 includes a plurality of resistors R1, R2, R3, R4, R5, R6, R7, R8 and R9 connected in series to generate different threshold levels to be output as voltage V2. These reference threshold levels will be higher than the predefined DC level generated by resistor ladder network 101. This means that only positive cycle of the music amplitude is considered for producing the music and light synchronization effect.

The reference threshold levels are outputted to V2 via the auto threshold scanner 106. An exemplary implementation of the auto threshold scanner 106 is to produce reference threshold levels which are generated through repeat scanning of a plurality of switches in the auto threshold switching block 103. The scanning signal is provided by the scanning logic block 104, which is basically a logic circuit generating sequential pulses to the auto threshold switching block 103. The series of sequential pulses shall be referred to as scanning signals, exemplarily implemented in the present invention being S1 to S8. The scanning signals periodically turn on and off the switches SW1 to SW8 in the auto threshold switching block 103 via signals generated from outputs S1 to S8 respectively. The scanning signal is also preferred to have a scanning frequency faster than audio signal. This is to ensure music signal of all audible frequencies are being decoded and no music signal is lost. The faster the scanning frequency, the more accurate is the sampling and decoding of the music signal.

The last stage of the analog to digital converter 100 is to compare the music signal riding on the predefined DC level V1' with the scanning threshold output to V2. This comparison is done by amplitude comparator unit, 105. This unit is made up of an operational amplifier as shown in exemplary implementation in FIG. 3.

Figure 4:
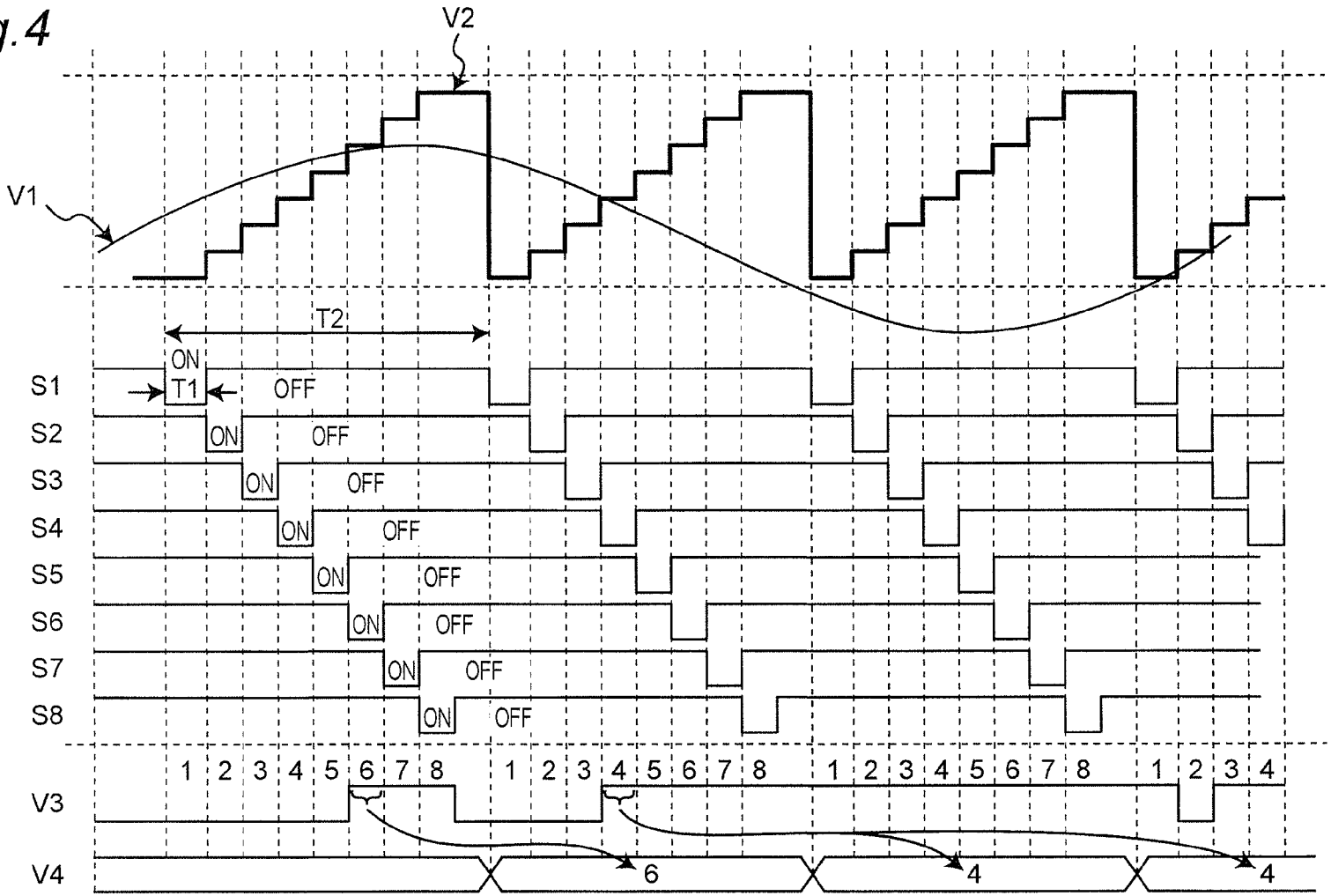
FIG. 4 shows the functional waveform produced from the ADC blocks.

The waveform involving the analog to digital converter 100 is presented in FIG. 4. V1 is a sine wave representing the waveform of a single phase of a typical ideal music signal. V1 will be riding on the predefined DC level V1' as determine by the voltage fixed by resistor ladder network 101. V2 shows the waveform output from the auto threshold scanner 106. As we can see, V2 waveform is a "staircase" like step-up waveform increasing from one threshold level to the next at a defined designed timing T1. At interval of T1, V2 voltage will increase to the next threshold level and this cycle repeat itself at interval for the whole T2 period. As mentioned earlier, the T2 timing has to be faster than the fastest audio frequency in order to maintain sampling accuracy of the music signal. T1 and T2 timing is determined by the scanning signals S1 to S8, as provided by the scanning logic block 104. This unit can be made by counter system to generate the required waveform S1~S8 as shown in FIG. 4. At the lowest step of the V2 waveform, it corresponds to switch SW1 of the auto threshold switching block 103 being turned on. The voltage output to V2 at this instant is represented as:

$$V2=R1/(R1+R2+R3+R4+R5+R6+R7+R8+R9)*V0.$$

At one time, only one signal among S1 to S8 will be Low and this Low signal are always follow a numeric sequence from S1 followed by S2 followed by S3 till S8 and the cycle repeats itself. After switch SW1 is turned on, the next cycle will be switch SW2 and the voltage at V2 will then be defined as:

$$V2=(R2+R1)/(R1+R2+R3+R4+R5+R6+R7+R8+R9)*V0.$$

Due to this repeated switching of voltage at V2, this forms a reference threshold level to identify the music amplitude at that instant. Voltage at V3 represents the output of amplitude comparator 105. This voltage at V3 output at High whenever V2 signal goes higher than V1 music signal. System will note when this voltage V3 goes high, that is at which cycle it is high among S1 to S8 scanning pulse. The higher the scan pulse that is needed to make V3 goes high means that the music volume at this instant is loud. This decoded level of the music volume is then stored or latched on after the end of the first 8 scan pulses. The new level of the updated music volume will only be refreshed after the end of the next 8 scan pulses. In this way, the system will constantly decode and update the instantaneous music volume level that is inputted into this system.

Output V3 of analog to digital converter 100 will be input to digital signal decoder 200 to process this digital level which represents the instantaneous analog music volume. The first building block that receives the V3 signal is the amplitude detector 201. The amplitude detector 201 acts as a memory or latch to store the V3 signal. For example, if V3 signal goes high during S6 Low pulse, Amplitude detector 201 will store a data "6" and output its equivalent digital signal value via V4. V4 may be exemplarily implemented by the binary equivalent of the stored data. For example the decimal data "6" will be represented by "110" as its binary equivalent. This storage will only take place at the end of the first batch of 8 scan pulses has been completed, where as exemplarily illustrated in FIG. 4 to be at the end of the period T2. Amplitude detector 201 will subsequently refresh its data after the end of the next 8 scan pulses. With reference to FIG. 4, the refresh rate of V4 is determined by the value of T2.

Signal V4 is further inputted to the music tempo decoder 210. An exemplary implementation of the music tempo decoder 210 shall now be described.

Figure 5:
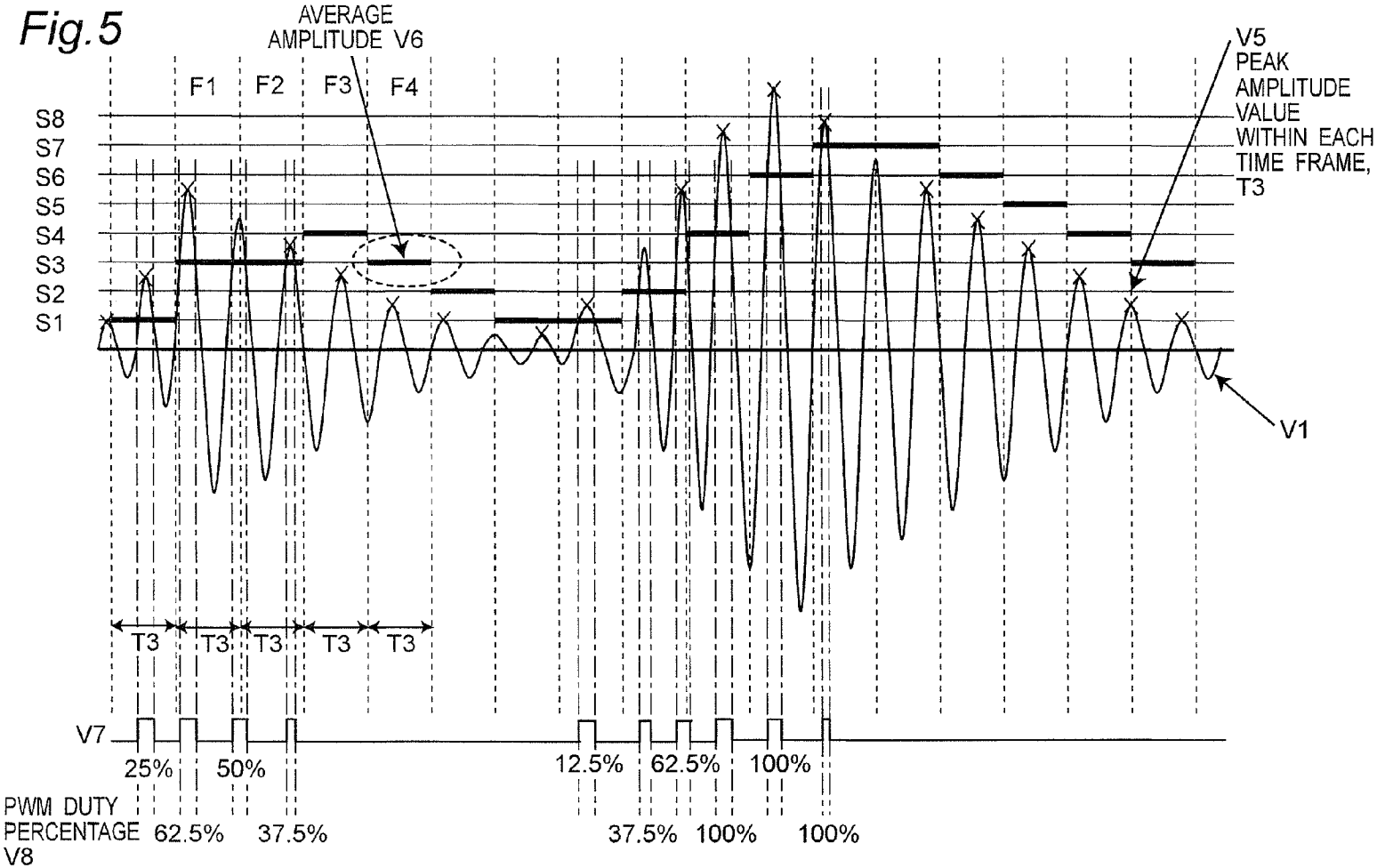
FIG. 5 shows the functional waveform produced from the digital signal decoder block.

The music tempo decoder 210 is exemplarily includes a peak amplitude detector 203, an averaging amplitude Unit 204 and an averaging amplitude comparator unit 205. The peak amplitude detector 203 detects the peak value of V4 and stores into another latch to memorize the current V4 value and outputs as signal V5. With reference to FIG. 5, the peak amplitude detector 203 detects the maximum value $V_{4,max}$ of V4 in a span of time frame T3, where T3 is related to T2 by the following relationship:

$$T3=n*T2,$$

with n referring to any constant more than 1. This means that the maximum value $V_{4,max}$ is determined among a few sets of sampled output from V4. In simple explanation, peak amplitude detector 203 determines the peak music signal amplitude after a few sets of sampled output V3 from the analog to digital converter 100. This peak value is determined by comparing the latched data of V4 over the period of time T3. This determines the peak music volume in the music signal over the period of time T3. The peak amplitude information over each period of T3 timing is indicated with a cross on V1 waveform in FIG. 5. This cross value or peak value is detected and stored in the latch of peak amplitude detector 203 in the form of threshold level from range of 1~8. This value is then output as signal V5 and then fed into the averaging amplitude unit 204.

The function of the averaging amplitude unit 204 is to sample the maximum value from the peak amplitude detector 203 and perform averaging. With reference to FIG. 5, the averaging amplitude unit 204 will perform averaging using peak amplitude information over a pre-determined span of several time frames of T3. For the purpose of explanation, an exemplary implementation of 4 time frames of T3 is used. 4 frames will make up to the current T3 time frame and the previous 3 previous T3 time frames. In this way, the average music amplitude is determined over a span of time equal to 4*T3. For example, with reference to FIG. 5, the portion of V6 that is circled is determined by the peak value from time frame F1~F4. The final decoded value at time frame F4 is determined by the average threshold level of time frame F1 which is equal to S5, frame F2 which is equal to S3, frame F3 which is equal to S2 and frame F4 which is equal to threshold S1. Hence, the average value of amplitude determined in time frame F4 is found to be $$S\text{-average}=(S5+S3+S2+S1)/4\approx S3 \text{ level}.$$

The average value in frame F4 is then set at threshold level S3 for that particular time frame. Subsequent time frames are also determined in the same manner. The average value shown by signal V6 is then stored in latch of averaging amplitude unit 204. This information will then be used to determine whether the light driver unit 300 be turned on or off later on.

The information determined by averaging amplitude unit 204 is output as V6 and coupled to the averaging amplitude comparator 205. The averaging amplitude comparator 205 compares the average value with the instantaneous amplitude that is detected by the analog to digital converter 100 and the amplitude detector 201. As such, the averaging amplitude comparator 205 compares the instantaneous amplitude of the inputted music signal with the S-average value V6, as outputted by the averaging amplitude unit 204. As long as the instantaneous amplitude of the inputted music signal is larger than the S-average value V6, the averaging amplitude comparator 205 will output a logic HIGH signal to signify an ON state for the Light driver unit 300 through the summing unit 206. The output V7 of the averaging amplitude comparator 205 will tell the light driver unit 300 to drive the lighting unit 400 to turn ON the light output, when the instantaneous amplitude of the inputted music signal is higher than the average value over the pre-determined span of time frame. If the instantaneous amplitude of the inputted music level is lower than the average value, the light output will be OFF.

The music tempo decoder 210 implementation solves the problem of the light output not synchronizing with the music tempo especially when the volume is very loud or when it is very soft. This is because, the level of music being compared is dynamic, hence constantly changing based on the average amplitude level of the present and previous few time frames. The average amplitude level is always made to compare with the instantaneous amplitude of the inputted music signal to determine whether light is to be turned on or off. This performs a compensation effect to make the light turn on and off and generate an effect of light blinking together with the music tempo. This gives a better visual effect of light being synchronized to the music tempo and beating.

Signal V4 is further inputted to the music volume decoder 202. An exemplary implementation of the music volume decoder 202 shall now be described.

The purpose of the music volume decoder 202 is to determine the brightness level of the light output to be linearly proportional to the amplitude of the inputted music signal. The function of this unit 202 is to generate a pulse-width modulating (PWM) signal whose duty cycle increases as music volume increases. The music volume decoder 202 may be implemented by a logic circuit. An exemplary implementation of the music volume decoder 202 generating the duty cycle of the PWM signal may be based on the relationship with output signal V3 of analog to digital converter, output signal V4 of the amplitude detector 201 and output signal V2 of the auto threshold switching 103, in the form of a look up table as shown in FIG. 6.

For example, if the output V4 of amplitude detector 201 is high at threshold level S8, the duty cycle output by the music volume decoder 202 is high at 100%, meaning light is output at 100% brightness with a large ON time or large duty cycle. When music level is at mid-volume of threshold S4, the duty output will be 50%. When music level is softer than the first threshold S2, duty cycle will be 0% meaning light output will be in OFF state. This duty information is outputted from the music volume decoder 202 through output signal V8.

By combining the output signal V7 of the music tempo decoder 210 and the music volume decoder 202 into a summing unit 206, we can control the brightness of light and also the ON/OFF or blinking effect of the light. Brightness of light output is determined by the music volume decoder 202 through the output V8 signal; whereas the ON/OFF or blinking effect of the light is determined by the averaging amplitude comparator 205 through the output V7 signal. This combines the effect of synchronizing with music tempo and beating by turning light ON/OFF, thus causing the blinking effect and the brightness level whenever ON signal is output is determined by the PWM duty level.

The output of the summer unit, in the form of a pulse width modulated signal, is then eventually outputted to the light driver unit 300 which in turn drives the lighting unit 400. Using above discussed system, light and music will be then synchronize with light brightness synchronizing with music volume amplitude and light will also blink on and off in accordance with music tempo and beating. This creates useful visual lighting effect to be used in several different types of application that produces element with light and music at the same time.

The invention claimed is:

1. An apparatus for synchronizing light signals to an analog music input signal having tempo and amplitude, the apparatus comprising:

an analog to digital converter to generate a digital signal equivalent of said analog music input signal;

a digital signal decoder to generate an output pulse width modulated signal that is representative of said tempo and said amplitude of said analog music input signal;

a light driver that receives said output pulse width modulated signal; and a light that emits light in correspondence with said output pulse width modulated signal received by said light driver, wherein said analog to digital converter comprises:

a first resistor ladder network to provide a DC bias to said analog music input signal to generate a DC biased analog music input signal;

a second resistor ladder network to generate threshold levels for comparing with said DC biased analog music input signal;

an auto threshold scanner coupled to said second resistor ladder network to generate a staircase waveform; and an amplitude comparator to compare said staircase waveform and said DC biased analog music input signal, and wherein said digital signal decoder comprises:

an amplitude detector to store current step information of said staircase waveform for which said amplitude comparator outputs a signal corresponding to an instantaneous amplitude of said analog music input signal;

a music tempo decoder that receives said current step information to perform an averaging of a plurality of said analog music input signals within a pre-determined time frame to generate a threshold level based on an averaged signal, and compare said threshold level with said instantaneous amplitude of said analog music input signal, so as to output a first pulse width modulated signal; and a music volume decoder that receives said current step information to produce a second pulse width modulated signal that has a duty cycle linearly proportional to said amplitude of said analog music input signal.

2. The apparatus according to claim 1, wherein said digital signal decoder further comprises:

a summing circuit to integrate outputs of said music tempo decoder and said music volume decoder so as to generate a third pulse width modulated signal for said light driver to light up said light with a brightness corresponding to said music volume decoder output, and a blinking effect corresponding to said music tempo decoder output.

3. The apparatus according to claim 1, wherein said music tempo decoder comprises:

a peak amplitude detector that receives said current step information and stores maximum current step information out of a sampling of a pre-determined number of maximum current step information;

an averaging amplitude determiner that takes in a predetermined number of samples of said maximum current step information stored by said peak amplitude detector and performs operations to obtain an average of said predetermined number of samples of said maximum current step information; and an averaging amplitude comparator to compare said current step information and said average of said predetermined number of samples of said maximum current step information.

* * * * *